United States Patent [19]

Dorfman et al.

[11] 3,995,961

[45] Dec. 7, 1976

[54] RING BINDER

[75] Inventors: Robert S. Dorfman, Atlantic Beach; Jack W. Dorfman, East Atlantic Beach, both of N.Y.

[73] Assignee: Jerome S. Serchuck, Great Neck, N.Y.

[22] Filed: Dec. 27, 1971

[21] Appl. No.: 212,339

Related U.S. Application Data

[63] Continuation-in-part of Ser. No. 12,352, Feb. 18, 1970, abandoned.

[52] U.S. Cl. ..... 402/38; 402/20

[51] Int. Cl.[2] ..... B42F 3/04

[58] Field of Search ..... 402/37, 38, 39, 40, 402/41, 36, 19–23, 31

[56] References Cited

UNITED STATES PATENTS

| | | | |
|---|---|---|---|
| 1,092,675 | 4/1914 | Traher | 402/39 |
| 3,105,494 | 10/1963 | Duncan | 402/36 |
| 3,132,649 | 5/1964 | Gits | 402/38 |
| 3,253,603 | 5/1966 | Levitan | 402/38 |
| 3,292,223 | 12/1966 | Esposito | 42/49 |
| 3,612,709 | 10/1971 | Miyamoto | 402/22 |

FOREIGN PATENTS OR APPLICATIONS

| | | | |
|---|---|---|---|
| 1,385,285 | 11/1964 | France | 402/38 |
| 764,557 | 12/1956 | United Kingdom | 402/41 |
| 1,104,022 | 2/1968 | United Kingdom | 402/41 |

*Primary Examiner*—Jerome Schnall

*Attorney, Agent, or Firm*—Ostrolenk, Faber, Gerb & Soffen

[57] ABSTRACT

A ring binder comprising a hollow spine divided into a stationary portion and a pair of movable portions integrally interconnected to one another through the intermediary of longitudinally extending scored folding lines. The two movable portions carry ring halves for movement toward and away from one another into closed and opened positions respectively. The movable portions are movable together with one another toward and away from the stationary portion into two extreme at-rest positions for opening and closing the ring halves.

7 Claims, 16 Drawing Figures

FIG. 8.
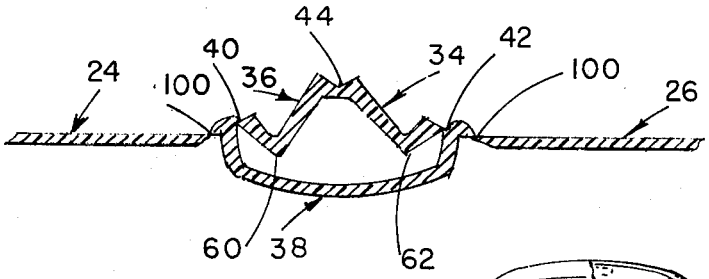
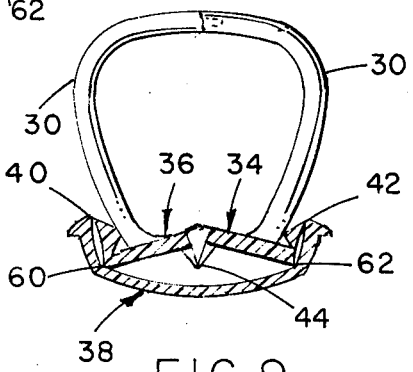
FIG. 9.
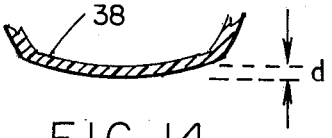
FIG. 14.
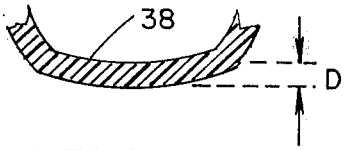
FIG. 13.
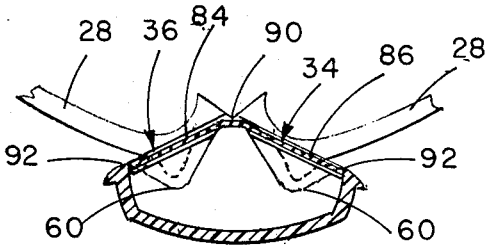
FIG. 10.
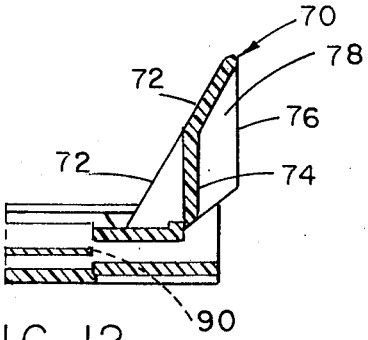
FIG. 12.
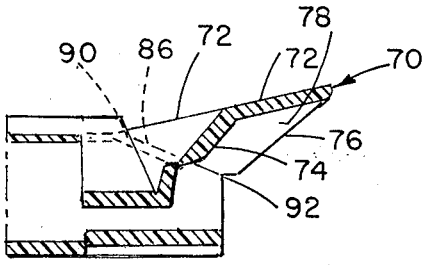
FIG. 11.

RING BINDER

CROSS-REFERENCE TO RELATED APPLICATIONS

This is a continuation-in-part of co-pending application Ser. No. 12,352, filed on Feb. 18, 1970, now abandoned.

BACKGROUND OF THE INVENTION

The present invention relates generally to ring binders for looseleaf papers and the like, and more particularly to a ring binder constituted of a hollow spine of unitary nature wherein each of the elements thereof are integrally interconnected to one another as a singular unit.

As is well known in the art, there are many ring binders for looseleaf pages which have, or have not, found commercial acceptance in the art. These ring binders are made in many different ways, have operative structure which cooperate with one another in many different ways and are constituted of many different materials such as metal and plastic or the like, each of the conventional ring binders having associated therewith certain advantages and, likewise, certain disadvantages. In this respect, depending on the complexity of the operative association of the various structure with one another, and the specific materials from which the ring binders are manufactured, and the tolerances maintained during the manufacture of the ring binder assembly, the ring binders will operate effectively or uneffectively, reliably or unreliably, and manufactured expensively or inexpensively.

The prior art represents efforts on the part of individuals for developing a ring binder which includes all of the advantages aforementioned in that attempts have been made at developing a ring binder which can be manufactured inexpensively, and will operate with simplicity, yet with reliability.

However, the conventional or prior art variety of ring binders has generally failed to most effectively blend the aforementioned requirements for achieving a most beneficial ring binder design and, therefore, there is somewhat of a void in the art.

In this respect, manufacturers are becoming increasingly aware that the utilization of plastic-like structure will result in an extremely inexpensive ring binder. However, because of the relationship of the structure of the ring binder, the structure being somewhat complex, the ring binder fails to operate in a most effective, reliable and simple fashion.

The conventional type of ring binder which is manufactured of plastic-like material, generally incorporates a plurality of elements which must be mechanically connected to one another, manually or by machine, after the various plastic-like elements have been molded. For example, there are a number of ring binders, of plastic-like nature, which include two separate members and are mechanically connected to one another so as to form the spine of the ring binder. One of the members is constituted as the base of the spine and is provided with generally upstanding sidewalls which terminate respectively in a socket-like elongate free edge. The other member of the spine is generally formed as two elongate segments hingedly associated with one another and integrally interconnected to one another through the intermediary of an elongate scored folding line.

The latter segments are provided with ring halves which are movable toward and away from one another as the latter segments are hingedly movable through the intermediary of the elongate scored folding line. Each of the latter segments is provided with an elongate free edge portion, which is generally rounded, or arcuate in cross-section, the free edge portions being insertable into the elongate edge sockets provided in the base member. This arrangement permits the segments of the second member to be hingedly movable toward and away from the base member about respective axes passing through the elongate sockets in the base member. As the segments of the second member are moved toward the base member, the ring halves carried by these segments are moved into engagement with one another annularly. As the segments of the second member are moved away from the base member, the ring halves are separated from one another in an open or spaced condition.

The disadvantage associated with this variety of prior, or conventional ring binder, rests in the general incapacity for the sockets to retain the arcuate free edge portions of the segments of the second member therein. Because of this incapacity, when the segments are moved away from the base member so as to separate the ring halves from one another, it is possible for the second member to become dislodged from the appropriate sockets therefor, and result in an undesirable disjoinder of the two members from one another, thereby, requiring repair of the spine.

Many attempts have been made in the prior art for overcoming this particular disadvantage such as providing on each of the segments, portions which jut outwardly so as to be hingedly engageable in abutting relation with the exterior of the base member and, thereby, limit the degree to which the segments are movable away from the base segment so as to retain the rounded free edge portions of the segments within the appropriate sockets therefor. Another arrangement for retaining the movable segments and base member in connected relation is the provision of longitudinally opposite ledges which are formed as part of the base member, each ledge provided with a longitudinal finger overlying and spaced from the movable segments and against which the movable segments are engageable for limiting the extent to which the movable segments are displaceable away from the base member.

Another ring binder arrangement for overcoming the aforementioned disadvantages, at least in part, relates to a singular member provided with a plurality of scored folding lines for dividing the element into a base portion and a pair of movable leaves, the leaves constituting the laterally opposite longitudinally extending end portions of the singular member. One leaf is provided with a free edge portion having an elongate socket-like configuration, whereas the other leaf is provided with a transversely rounded elongated edge portion for being generally mechanically interfitted in the socket-like edge portion of the other leaf, each of the leaves carrying respective ring halves for association with one another. The disadvantage associated with this arrangement rests in the tendency for the leaves to become separated from one another at the common joint, namely the interfitted free edges of the leaves respectively and, thereby, in a manner as discussed above for the first mentioned variety of ring binders, require longitudinally opposite abutment ledges for limiting the maximum extent to which the leaves may be moved away from the base portion of the ring binder to prevent the leaves from becoming disjoined from one another.

Clearly, the necessity for providing, as in the prior art, the additional structure for preventing inadvertent separation and disjoinder of the ring binder components from one another, is somewhat of an indication of the problems, heretofore not most effectively solved, when attempting to manufacture ring binders having a plurality of members which require some form of mechanical interconnection to one another.

SUMMARY OF THE INVENTION

Accordingly, it is an object of the present invention to provide an improved ring binder which obviates the disadvantages associated with the prior art.

It is another object of the present invention to provide a ring binder spine which is manufactured with a unitary hollow body, divided into a number of movable segments which are all integrally interconnected to one another and requires absolutely no mechanical interconnection of the basic operative portions thereof.

It is still a further object of the present invention to provide a ring binder constituted of light-weight plastic material which may be manufactured easily and inexpensively.

It is still another object of the present invention to provide a ring binder having elements associated therewith that cannot be inadvertently separated or disjoined from one another, thereby, obviating breakdown and the like.

It is another object of the present invention to provide a ring binder having integrally associated therewith an actuation tab which functions in combination with the ring carrying segments as a toggle assembly for moving the ring halves into and out of operative association with one another.

To this end, the present invention relates generally to a ring binder comprising a hollow spine, said spine having a plurality of longitudinally extending scored folding lines spaced laterally from one another in generally parallel relation, said scored folding lines dividing said hollow spine into three segments integrally interconnected to one another laterally in a continuous closed array, one of said segments being generally stationary, the others of said segments being movable laterally between two extreme at-rest positions toward and away from respectively the stationary segment, each movable segment including at least one ring-half for operative association with a ring-half of the other movable segment, the ring-halves being movable into and out of annular engagement with one another when said movable segments are moved toward and away from respectively said stationary segment, one of said scored folding lines interconnecting said movable segments to one another and constituting means for limiting movement of the movable segments together between both said two extreme at-rest positions.

BRIEF DESCRIPTION OF THE DRAWINGS

With the above and additional objects and advantages in view, as will hereinafter appear, this invention comprises the devices, combinations and arrangements of parts hereinafter described and illustrated in the accompanying drawings of a preferred embodiment in which:

FIG. 8 is a cross-sectional view taken along the line 8—8 in FIG. 1;

FIG. 9 is a partially cross-sectional view taken along the line 9—9 in FIGS. 2 and 3, the ring halves, however, being shown in a closed condition;

FIG. 10 is a partially cross-sectional view taken along the line 10—10 in FIG. 2, the ring halves shown in an open condition and fragmented;

FIG. 11 is a cross-sectional view taken along the line 11—11 in FIG. 2;

FIG. 12 is a cross-sectional view similar to that of FIG. 11, the actuating tab illustrated in a position for maintaining the ring halves in a closed condition;

FIG. 13 is a fragmented cross-sectional view taken along the line 13—13 in FIG. 3 and represents, if desired, an additional feature of the present invention; and FIG. 14 is a fragmented cross-sectional view taken along the line 14—14 in FIG. 3A as associated with the feature illustrated in FIG. 13.

DETAILED DESCRIPTION OF THE INVENTION

Figure 1:
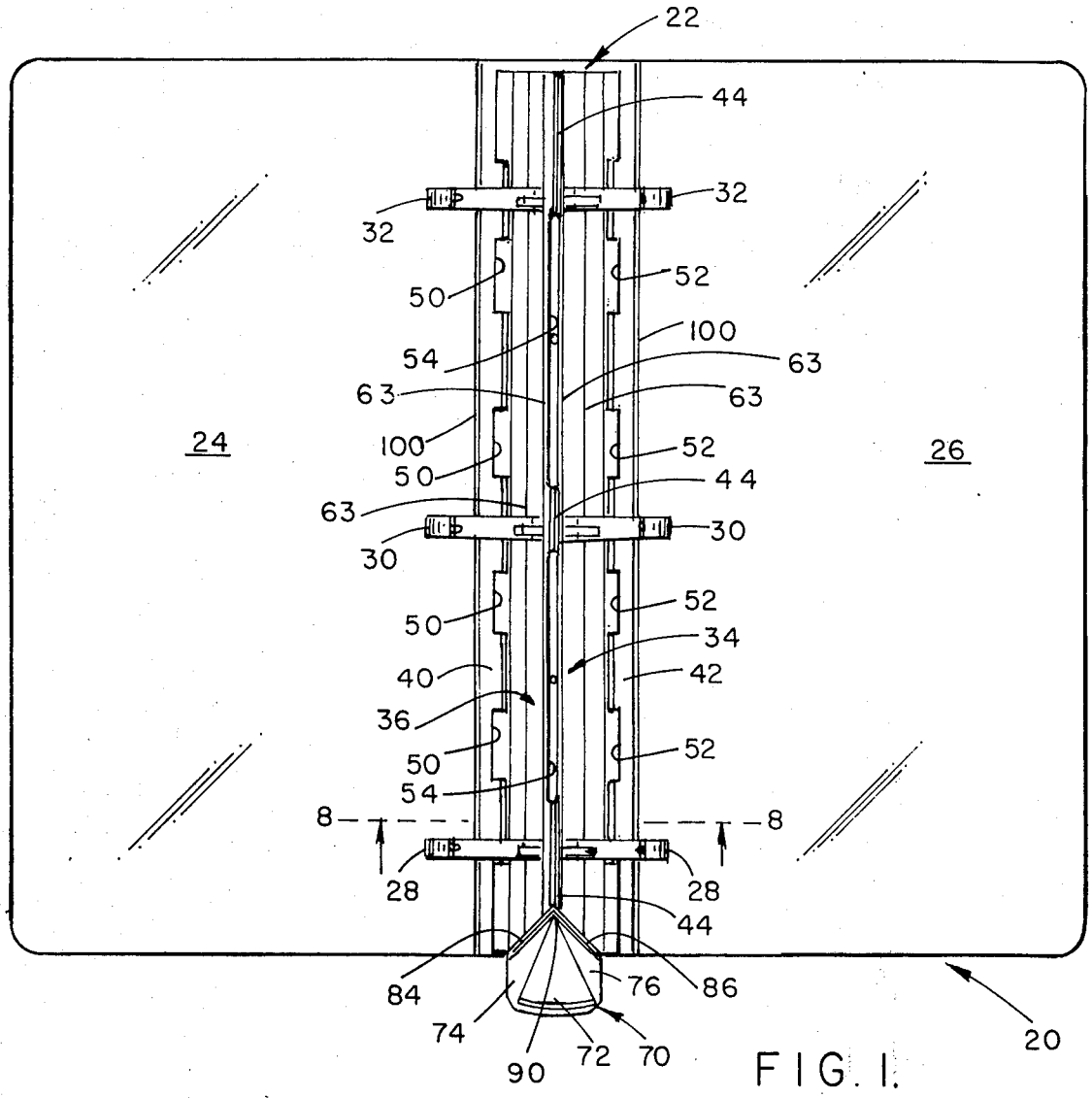
FIG. 1 is a top plan view of the ring binder pursuant to one embodiment of the present invention.

Referring now to the drawings and more particularly to FIG. 1 thereof, the present invention relates generally to a ring binder arrangement denoted generally by the reference character 20. The ring binder 20 includes a hollow spine 22 constituted as an integral, preferably thermoplastic unit, which may, in accordance with one embodiment of the invention, or may not, in accordance with the preferred embodiment of the present invention, be provided integrally with front and rear book-cover flaps 24 and 26 respectively.

Figure 2:
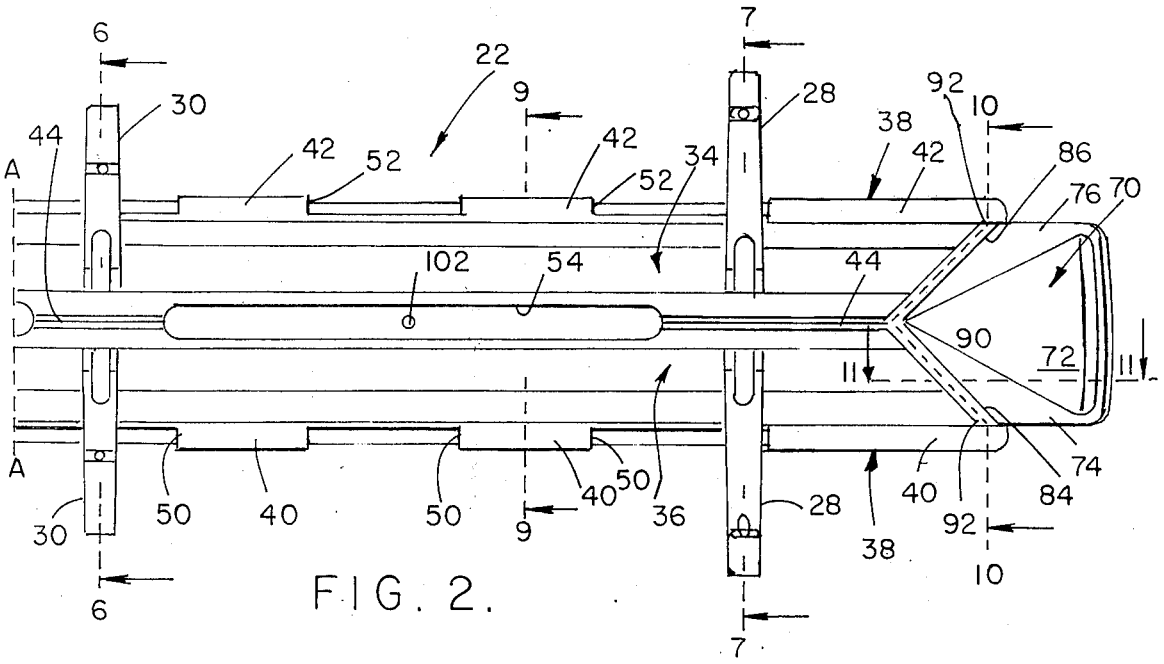
FIGS. 2 and 2A are top plan views of a preferred embodiment of the present invention and are associated with one another through the intermediary of line A—A therein respectively.
Figure 3:
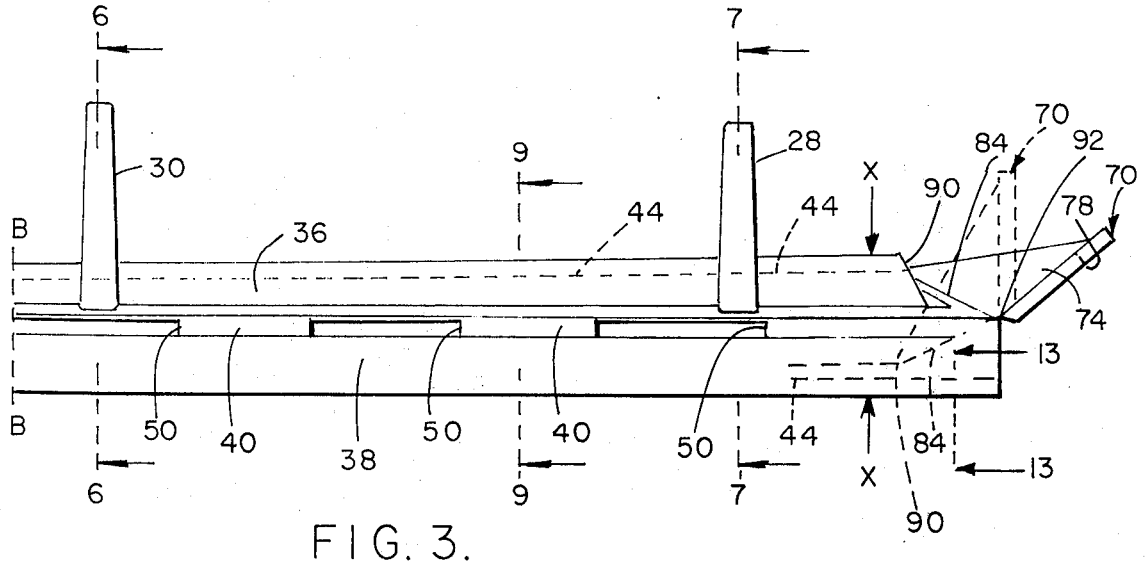
FIGS. 3 and 3A are side elevational views of the arrangement illustrated in FIGS. 2 and 2A and are associated with one another through the intermediary of line B-B therein respectively.
Figure 2A:
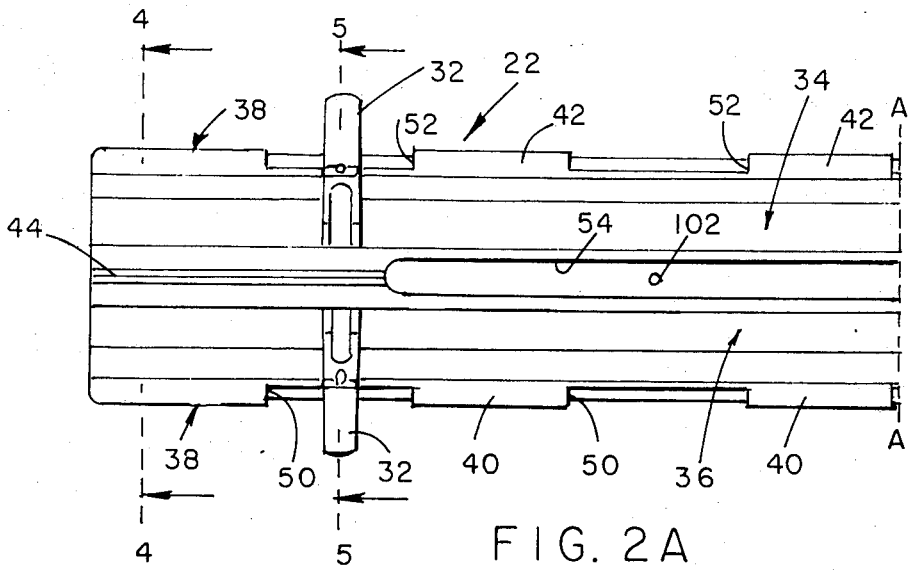

Pursuant to the preferred embodiment of the present invention, as illustrated in FIGS. 2 and 3, the hollow spine 22 is formed with a first pair of ring halves 28, a second pair of ring halves 30, and still a third pair of ring halves 32. In this respect, one ring half from each of the pairs 28, 30 and 32 respectively, is formed as part of respective elongate movable leaf segments 34 and 36 respectively, the latter segments being carried upon a stationary base segment 38 for movement toward and away from the latter, as will be described below. The base segment 38 includes a pair of spaced apart longitudinal side members extending upwardly from opposite longitudinal ends of a base member of said base segment, as clearly shown in the drawings.

In this respect, the movable leaf segments 34 and 36 and the stationary base segment 38 are integrally interconnected to one another for association with one another in toggle relation, as will be clarified below, through the intermediary of longitudinally extending scored folding lines or elongate zones of reduced thickness 40, 42 and 44 respectively as is best illustrated in FIGS. 4–7.

Figure 4:
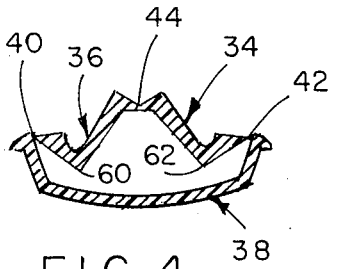
FIG. 4 is a front cross-sectional view taken along the line 4—4 in FIGS. 2A and 3A.

The above discussion is a description, at least in part, of a preferred embodiment of the present invention, wherein the hollow spine 22 is a singular hollow body constituted preferably of thermoplastic, such as of polypropelene, having a filler such as of talcum or the like, so as to be generally stiff longitudinally, yet imparts, at least to the base segment 38, a preferred degree of lateral elasticity. In this respect, the distance separating the scored folding lines 40 and 42, as illustrated in FIG. 4, is less than the combined distances between the scored folding lines 40 and 44 and 44 and 42. Thus, because of the lateral elasticity of the base segment 38, the movable leaf segments 34 and 36 respectively, which are interconnected to one another through the intermediary of the longitudinally scored folding line 44, may be hingedly moved respectively about the scored folding lines 40 and 42 respectively toward and away from the base segment 38 between two extreme at-rest positions, in toggle relation, such that the scored folding line 44 is above the scored folding lines 40 and 42 respectively, or below the latter scored folding lines.

Figure 5:
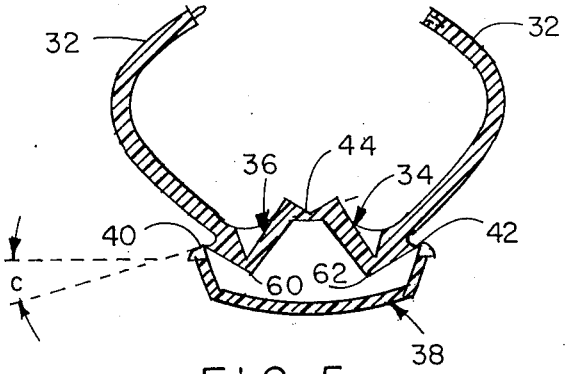
FIG. 5 is a cross-sectional view taken along the line 5—5 in FIGS. 2A and 3A.
Figure 6:
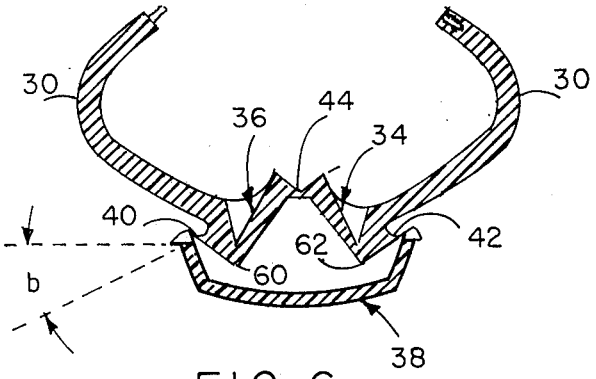
FIG. 6 is a cross-sectional view taken along the line 6—6 in FIGS. 2 and 3.
Figure 7:
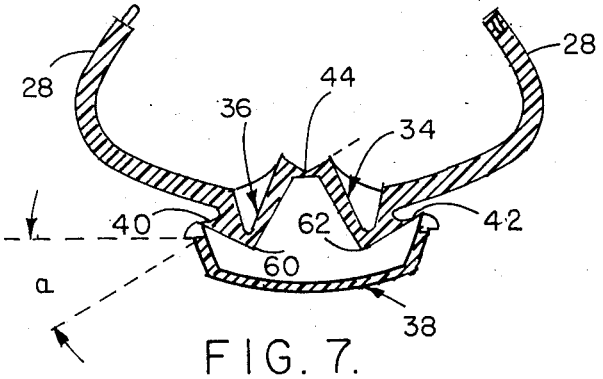
FIG. 7 is a cross-sectional view taken along the line 7—7 in FIGS. 2 and 3.

One at-rest position is illustrated in FIGS. 5–7 wherein the ring halves are in an open or spaced condition, the movable leaf segments 34 and 36 respectively being maintainted with one another in a remote-most extreme at-rest position away from the interior of the base segment 38.

On the other hand, as illustrated in FIG. 9, the movable leaf segments 34 and 36 respectively are maintained with one another in a proximate-most extreme at-rest position adjacent the interior of the base segment 38 such that the ring halves are brought into generally annular engagement with one another and extend in closed relation.

Because of the lateral elasticity of the base segment 38, which has an at-rest configuration which maintains the longitudinally scored folding lines 40 and 42 respectively at a lesser distance from one another than the combined lateral extent of the movable leaf segments 34 and 36 respectively, the latter leaf segments may be moved toward and away from the interior of the base segment 38 into two extreme at-rest positions for opening and closing the ring halves associated therewith as the base segment laterally expands and contracts when the leaf segments 34 and 36 pass through a horizontal plane defined by the scored folding lines 40 and 42, which horizontal plane represents an unstable position for the leaves 34 and 36.

It is a significant feature of the present invention that the hollow spine is constituted as an integral unit requiring absolutely no mechanical interconnection of parts thereof and, therefore, will not be subjected to a disjoinder of the various segments thereof from one another, when used; namely, the leaf segments 34 and 36 cannot be disjoined from one another along the scored folding line 44, nor can the latter leaf segments be disjoined from the base segment 38 along the respective scored folding lines 40 and 42.

Moreover, the provision of the centrally disposed scored folding line 44, which interconnects the movable leaf segments 34 and 36 to one another respectively, acts to limit the extent to which the movable leaf segments may be moved away from the interior of the base segment 38 without any necessity for providing abutments or the like on either of the movable leaf segments 34 and 36 themselves, or upon the base segment 38 for limiting the degree to which the ring halves will be opened for preventing disjoinder of the various segments relative to one another as otherwise described above in the prior art, wherein there are a plurality of portions which are interconnected to one another mechanically.

In order to enhance the ease by which the leaf segments 34 and 36 respectively are movable toward and away from the interior of the base segment 38, the longitudinally extending scored folding lines 40 and 42 respectively are provided with a plurality of elongate slots 50 and 52 respectively, whereas the scored folding line 44, which interconnects the leaf segments 34 and 36 to one another respectively, is provided with a plurality of slots 54 therein.

Another feature pursuant to the preferred embodiment of the present invention may be appreciated by referring now to FIGS. 4-7 and 9. This feature relates to the provision of elongate inner rib-like members 60 and 62 respectively along the interior or undersurfaces respectively of the movable leaf segments 34 and 36. These rib-like members 60 and 62 respectively, extend remote from the longitudinal scored folding line 44 which interconnects the movable leaf segments 34 and 36 to one another and proximate the scored folding lines 40 and 42 respectively so as to be most effectively engageable with the interior of the base segment 38, as illustrated in FIG. 9, when the ring halves are brought into a closed condition as the movable leaf segments 34 and 36 respectively are moved toward the interior of the base segment 38.

Thus, the rib-like members or portions 60 and 62 respectively act to limit the extent to which the movable leaf segments 34 and 36 respectively can be moved into their at-rest position, as illustrated in FIG. 9, so as not to overstress or overdeform the ring halves when in their closed annular condition. In the absence of the rib-like portions 60 and 62 respectively, because of the lateral elasticity of the base segment 38, it would be possible for the movable leaf segments 34 and 36 respectively to be brought into contact with the base segment 38 at their common scored folding line 44 and, thereby, cause the mating portions of the ring halves to over-exert mutual pressure against one another, unless, and this likewise is contemplated by the present invention, the ring halves were specifically designed so as to come into contact with one another just as the scored folding line 44 is brought into contact with the base segment 38.

The advantage of maintaining the scored folding line 44 in spaced relation with the base segment 38, when in either of the two at-rest positions of the movable segments 34 and 36 respectively, is that the latter movable leaf segments 34 and 36 respectively need only undergo minimal movement between the two at-rest positions and, thus, the operation of the assembly is more simple and effective.

Although, as illustrated in FIG. 9, the movable leaf segments 34 and 36 respectively are shown as having a somewhat upwardly inclined extent from the rib portions 60 and 62 respectively to the scored folding line 44 therebetween, the movable leaf segments 34 and 36 are, nonetheless, in an at-rest lowermost toggle position since the scored folding line 44 is well below the scored folding lines 40 and 42 which interconnects the movable leaf segments 36 and 34 respectively to the base segment 38. Thus, from the at-rest position, as illustrated in FIG. 9, the movable leaf segments 34 and 36 respectively are movable to a second at-rest position as illustrated in FIGS. 4–7 respectively wherein the scored folding line 44 is above the scored folding lines 40 and 42 respectively, the entire movement from one at-rest position as illustrated in FIG. 9 to a second at-rest position as illustrated in FIGS. 4–7, being of minimal extent, but resulting, nonetheless, in the widely spacing of the ring halves from one another as illustrated in FIGS. 5–7, or in the closed position as illustrated in FIG. 9.

It is significant to note, that the rib-like members 60 and 62 along the underside of the segments 34 and 36 also add a degree of stiffening to the latter members. Moreover, further rib-like members 63 may be provided longitudinally on the top surface of the segments 34 and 36 to enhance stiffening to a preferred degree. Likewise, lateral ribs (not shown) may be provided on the segments 34 and 36 for stiffening.

Referring now to FIGS. 2, 3, 11 and 12, a preferred embodiment of the present invention is to be provided with an actuating tab 70 having a central triangular portion 72 and a pair of side triangular portions 74 and 76 respectively all bent relative to one another so as to defiine a concavity 78 along the underside of the actuating tab 70, as illustrated in FIGS. 11 and 12, the actuating tab 70 having a generally uniform thickness throughout its extent including the portions thereof which define the bends between the central and side triangular portions 72, 74 and 76 respectively.

The actuating tab 70 is interconnected to the movable leaf segments 34 and 36 respectively through the intermediary of a pair of intersecting scored folding lines 84 and 86 respectively, the latter intersecting scored folding lines intersecting one another and the scored folding line 44 which interconnects the movable leaf segments 34 and 36 respectively to one another at a common point 90. Moreover, the intersecting scored folding lines 84 and 86 respectively intersect the scored folding lines 40 and 42 respectively at side terminal points 92 respectively.

Accordingly, the actuating tab 70 may be utilized for moving the movable leaf segments 34 and 36 respectively toward and away from the interior of the base segment 38 between the two extreme at-rest positions for opening and closing the ring halves relative to one another. Thus, the common point 90, which represents the intersection of the intersecting scored folding lines 84 and 86 with one another and with the scored folding line 44, is movable between two extreme at rest positions in a toggle fashion as described above, namely carried by the interconnected leaf segments 34 and 36 respectively.

Although only one actuating tab 70 is provided on the ring binder 20 at one end thereof, a second actuating tab may be utilized at the opposite end of the ring binder 20 so as to cooperate with the first mentioned actuating tab 70 for opening and closing the ring halves relative to one another. However, the preferred embodiment utilizes only one actuating tab 70 and in order to facilitate the movement of the movable leaf segments 34 and 36 into their two at-rest positions, the movable leaf segments 34 and 36 respectively are commonly tapered from one end thereof, that end which is provided with the actuating tab 70, to the opposite end thereof.

Figure 3A:
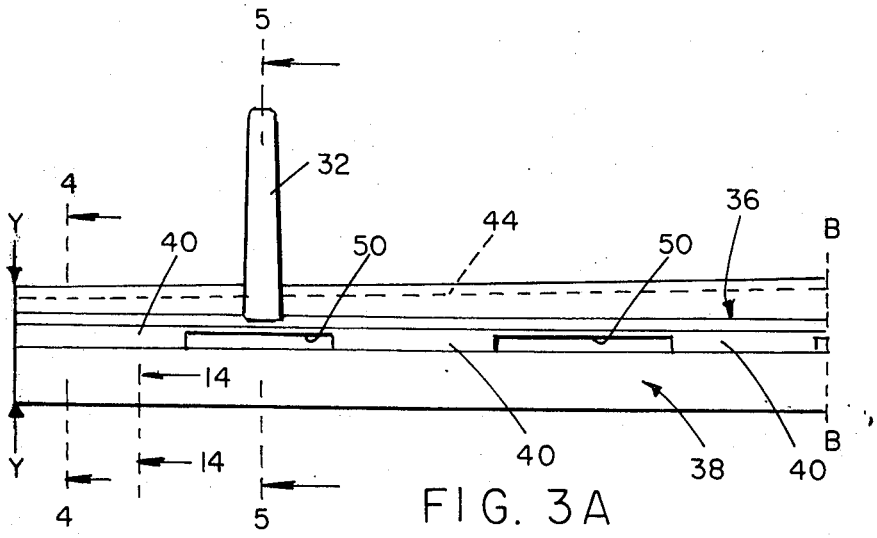

In this respect, the common taper is effected along the scored folding line 44 such that the vertical height of the ring binder 20 when in an open condition, at the end to which is connected the actuating tab 70, and denoted by the reference character X in FIG. 3, is greater than the vertical height thereof at the opposite end denoted in FIG. 3A by the spacing Y. Therefore, when the actuating tab is moved from a position in solid line in FIG. 3 and in cross-section in FIG. 11, to a position as illustrated in phantom in FIG. 3 and solid line in FIG. 12, the force applied to the common point 90 will be appropriately and effectively transmitted throughout the longitudinal extent of each of the movable leaf segments 34 and 36 respectively from one end to the other and permit the ring halves to be moved into their respective open and closed positions.

The taper of the segments 34 and 36 may be appreciated by referring to FIGS. 5–7, wherein the scored folding lines 40 and 44 define an inclined line which makes an angle with a horizontal line defined by the scored folding lines 40 and 42. The angle between the inclined and horizontal lines gradually decreases from FIG. 7, to FIG. 6, to FIG. 5 from angle *a* (25° preferably), to angle *b* (20° preferably), to angle *c* (15° preferably) respectively. In other words, the angle decreases as the lateral extent of the leaves 34 and 36 decreases.

It has also been determined that when utilizing a single actuating tab that the thickness of the base segment 38 can be gradually reduced from a maximum thickness as illustrated in FIG. 13 adjacent the actuating tab 70 to a minimum thickness as illustrated in FIG. 14 at the end remote from that of the actuating tab 70. By reducing the thickness of the base segment 38 from one end to the other, the force applied to the common point 90 by the actuating tab 70 will not be dissipated along the extent of the base segment 38 and, therefore, the latter will be permitted to elastically expand laterally so as to permit the movement of the movable leg segments 34 and 36 respectively between the two extreme at-rest positions. The provision of a base segment having a gradually reducing thickness may be effected in the absence of utilizing a pair of movable segments which gradually taper laterally from one end to the other as illustrated in FIGS. 3 and 3A, or may be utilized in combination therewith.

Pursuant to an alternative embodiment of the present invention, as illustrated in FIGS. 1 and 8, the ring binder 20 may be provided with a pair of outermost scored folding lines 100 for integrally interconnecting the front and rear book cover flaps 24 and 26 respectively to the hollow spine 22. By manufacturing the hollow spine 22 with the front and rear book cover flaps 24 and 26 respectively in a manner as illustrated in FIGS. 1 and 8 respectively, there is obviated the necessity for subsequently having to mechanically interconnect the book cover flaps to one another as is normally required for loose leaf book binders. Alternatively, the base segment 38 may be provided with a pair of openings 102 for being mechanically fastened by rivets or the like through an assembled book cover flap arrangement.

Numerous alterations of the structure herein disclosed will suggest themsleves to those skilled in the art. However, it is to be understood that the present disclosure relates to a preferred embodiment of the invention which is for purposes of illustration only and is not to be construed as a limitation of the invention.

What is claimed is:

1. A ring binder comprising a one piece body including a stationary base segment and first and second leaf segments, said base segment including a pair of spaced apart longitudinal side members extending upwardly from opposite longitudinal ends of a base member of said base segment.

a first longitudinally extending portion of reduced thickness being integrally hingedly connected between an upper longitudinal portion of one of said side members and an outer longitudinal portion of said first leaf segment, a second longitudinally extending portion of reduced thickness being integrally hingedly connected between an upper longitudinal portion of the other of said side members and an outer longitudinal portion of said second leaf segment, a third longitudinally extending portion of reduced thickness being integrally hingedly connected between an inner longitudinal portion of said first leaf segment and an inner longitudinal portion of said second leaf segment so that said base segment and said first and second leaf segments define a longitudinally hollow spine, said first and second leaf segments being vertically movable between a first at-rest position and a second at-rest position, said inner portions of said first and second leaf segments being closer to said base member in said first at-rest position than in said second at-rest position, said outer longitudinal portions of said first and second leaf segments when in said at-rest positions having a first transverse spacing therebetween substantially equal to a second transverse spacing between said upper longitudinal portions of said side members, said outer longitudinal portions of said first and second leaf segments when disposed in any other position between said at-rest positions having a third transverse spacing therebetween substantially equal to a fourth transverse spacing between said upper longitudinal portions of said side members, said base segment being at least partially elastic laterally to allow outward movement of said upper longitudinal portions of said side members from said second transverse spacing to said fourth transverse spacing, said third transverse spacing between said outer longitudinal portions of said first and second leaf segments being greater than said second transverse spacing between said upper longitudinal portions of said side members to effect a toggle-like joint limiting said first and second leaf segments to either one of first and second at-rest positions, each of said first and second segments having at least one ring half integrally formed therewith, said one ring half on said first leaf segment being correspondingly disposed in confronting relationship with said one ring half provided on said second leaf segment, said corresponding ring halves being movable between a contacting position when said first and second leaf segments are in said first at-rest position and a laterally spaced apart position when said first and second leaf segments are in said second at-rest position;

said first and second longitudinal extending portions of reduced thickness being each provided with at least one longitudinal slot therethrough in order to enhance the ease with which said first and second leaf segments are movable between said first and second at-rest positions.

2. A ring binder comprising a one piece body including a stationary base segment and first and second leaf segments, said base segment including a pair of spaced apart longitudinal side members extending upwardly from opposite longitudinal ends of a base member of said base segment, a first longitudinally extending portion of reduced thickness being integrally hingedly connected between an upper longitudinal portion of one of said side members and an outer longitudinal portion of said first leaf segment, a second longitudinally extending portion of reduced thickness being integrally hingedly connected between an upper longitudinal portion of the other of said side members and an outer longitudinal portion of said second leaf segment, a third longitudinally extending portion of reduced thickness being integrally hingedly connected between an inner longitudinal portion of said first leaf segment and an inner longitudinal portion of said second leaf segment so that said base segment and said first and second leaf segments define a longitudinally hollow spine, said first and second leaf segments being vertically movable between a first at-rest position and a second at-rest position, said inner portions of said first and second leaf segments being closer to said base member in said first at-rest position than in said second at-rest position, said outer longitudinal portions of said first and second leaf segments when in said at-rest positions having a first transverse spacing therebetween substantially equal to a second transverse spacing between said upper longitudinal portions of said side members, said outer longitudinal portions of said first and second leaf segments when disposed in any other position between said at-rest positions having a third transverse spacing therebetween substantially equal to a fourth transverse spacing between said upper longitudinal portions of said side members, said base segment being at least partially elastic laterally to allow outward movement of said upper longitudinal portions of said side members from said second transverse spacing to said fourth transverse spacing, said third transverse spacing between said outer longitudinal portions of said first and second leaf segments being greater than said second transverse spacing between said upper longitudinal portions of said side members to effect a toggle-like joint limiting said first and second leaf segments to either one of first and second at-rest positions, each of said first and second segments having at least one ring half integrally formed therewith, said one ring half on said first leaf segment being correspondingly disposed in confronting relationship with said one ring half provided on said second leaf segment, said corresponding ring halves being movable between a contacting position when said first and second leaf segments are in said first at-rest position and a laterally spaced apart position when said first and second leaf segments are in said second at-rest position;

said third longitudinal extending portion of reduced thickness being provided with at least one longitudinal slot therethrough in order to enhance the ease with which said first and second leaf segments are movable between said first and second at-rest positions.

3. A ring binder comprising a one piece body including a stationary base segment and first and second leaf segments, said base segment including a pair of spaced apart longitudinal side members extending upwardly from opposite longitudinal ends of a base member of said base segment, a first longitudinally extending portion of reduced thickness being integrally hingedly connected between an upper longitudinal portion of one of said side members and an outer longitudinal portion of said first leaf segment, a second longitudinally extending portion of reduced thickness being integrally hingedly connected between an upper longitudinal portion of the other of said side members and an outer longitudinal portion of said second leaf segment, a third longitudinally extending portion of reduced thickness being integrally hingedly connected between an inner longitudinal portion of said first leaf segment and an inner longitudinal portion of said second leaf segment so that said base segment and said first and second leaf segments define a longitudinally hollow spine, said first and second leaf segments being vertically movable between a first at-rest position and a second at-rest position, said inner portions of said first and second leaf segments being closer to said base member in said first at-rest position than in said second at-rest position, said outer longitudinal portions of said first and second leaf segments when in said at-rest positions having a first transverse spacing therebetween substantially equal to a second transverse spacing between said upper longitudinal portions of said side members, said outer longitudinal portions of said first and second leaf segments when disposed in any other position between said at-rest positions having a third transverse spacing therebetween substantially equal to a fourth transverse spacing between said upper longitudinal portions of said side members, said base segment being at least partially elastic laterally to allow outward movement of said upper longitudinal portions of said side members from said second transverse spacing to said fourth transverse spacing, said third transverse spacing between said outer longitudinal portions of said first and second leaf segments being greater than said second transverse spacing between said upper longitudinal portions of said side members to effect a toggle-like joint limiting said first and second leaf segments to either one of first and second at-rest positions, each of said first and second segments having at least one ring half integrally formed therewith, said one ring half on said first leaf segment being correspondingly disposed in confronting relationship with said one ring half provided on said second leaf segment, said corresponding ring halves being movable between a contacting position when said first and second leaf segments are in said first at-rest position and a laterally spaced apart position when said first and second leaf segments are in said second at-rest position;

said first and second leaf segments being provided with rib-like means for stiffening said first and second leaf segments;

said rib-like means include rib-like members disposed longitudinally along undersurfaces of said first and second leaf segments for abutting against said base segment in said first at-rest position to limit the extent to which said first and second leaf segments can be moved.

4. A ring binder comprising a one piece body including a stationary base segment and first and second half segments, said base segment including a pair of spaced apart longitudinal side members extending upwardly from opposite longitudinal ends of a base member of said base segment, a first longitudinally extending portion of reduced thickness being integrally hingedly connected between an upper longitudinal portion of one of said side members and an outer longitudinal portion of said first leaf segment, a second longitudinally extending portion of reduced thickness being integrally hingedly connected between an upper longitudinal portion of the other of said side members and an outer longitudinal portion of said second leaf segment, a third longitudinally extending portion of reduced thickness being integrally hingedly connected between an inner longitudinal portion of said fist leaf segment and an inner longitudinal portion of said second leaf segment so that said base segment and said first and second leaf segments define a longitudinally hollow spine, said first and second leaf segments being vertically movable between a first at-rest position and a second at-rest position, said inner portions of said first and second leaf segments being closer to said base member in said first at-rest position than in said second at-rest position, said outer longitudinal portions of said first and second leaf segments when in said at-rest positions having a first transverse spacing therebetween substantially equal to a second transverse spacing between said upper longitudinal portions of said side members, said outer longitudinal portions of said first and second leaf segments when disposed in any other position between said at-rest positions having a third transverse spacing therebetween substantially equal to a fourth transverse spacing between said upper longitudinal portions of said side members, said base segment being at least partially elastic laterally to allow outward movement of said upper longitudinal portions of said side members from said second transverse spacing to said fourth transverse spacing, said third transverse spacing between said outer longitudinal portions of said first and second leaf segments being greater than said second transverse spacing between said upper longitudinal portions of said side members to effect a toggle-like joint limiting said first and second leaf segments to either one of first and second at-rest positions, each of said first and second segments having at least one ring half integrally formed therewith, said one ring half on said first leaf segment being correspondingly disposed in confronting relationship with said one ring half provided on said second leaf segment, a said corresponding ring halves being movable between a contacting position when said first and second leaf segments are in said first at-rest position and a laterally spaced apart position when said first and second leaf segments are in said second at-rest position;

one end portion of said hollow spine being provided with actuating means integrally connected to said first and second leaf segments for moving said first and second segments between said first and second at-rest positions;

said first transverse spacing between said outer longitudinal portions of said first and second leaf segments being tapered from a maximum spacing at said one end portion of said hollow spine to a minimum spacing at an opposite end portion of said hollow spine to transmit force of said actuating means from said one end portion of said hollow spine to said opposite end portion of said hollow spine.

5. A ring binder comprising a one piece body including a stationary base segment and first and second leaf segments, said base segment including a pair of spaced apart longitudinal side members extending upwardly from opposite longitudinal ends of a base member of said base segment, a first longitudinally extending portion of reduced thickness being integrally hingedly connected between an upper longitudinal portion of one of said side members and an outer longitudinal portion of said first leaf segment, a second longitudinally extending portion of reduced thickness being integrally hingedly connected between an upper longitudinal portion of the other of said side members and an outer longitudinal portion of said second leaf segment, a third longitudinally extending portion of reduced thickness being integrally hingedly connected between an inner longitudinal portion of said first leaf segment and an inner longitudinal portion of said second leaf segment so that said base segment and said first and second leaf segments define a longitudinally hollow spine, said first and second leaf segments being vertically movable between a first at-rest position and a second at-rest position, said inner portions of said first and second leaf segments being closer to said base member in said first at-rest position than in said second at-rest position, said outer longitudinal portions of said first and second leaf segments when in said at-rest positions having a first transverse spacing therebetween substantially equal to a second transverse spacing between said upper longitudinal portions of said side members, said outer longitudinal portions of said first and second leaf segments when disposed in any other position between said at-rest positions having a third transverse spacing therebetween substantially equal to a fourth transverse spacing between said upper longitudinal portions of said side members, said base segment being at least partially elastic laterally to allow outward movement of said upper longitudinal portions of said side members from said second transverse spacing to said fourth transverse spacing, said third transverse spacing between said outer longitudinal portions of said first and second leaf segments being greater than said second transverse spacing between said upper longitudinal portions of said side members to effect a toggle-like joint limiting said first and second leaf segments to either one of first and second at-rest positions, each of said first and second segments having at least one ring half integrally formed therewith, said one ring half on said first leaf segment being correspondingly disposed in confronting relationship with said one ring half provided on said second leaf segment, said corresponding ring halves being movable between a contacting position when said first and second leaf segments are in said first at-rest position and a laterally spaced apart position when said first and second leaf segments are in said second at-rest position;

one end portion of said hollow spine being provided with actuating means integrally connected to said first and second leaf segments for moving said first and second segments between said first and second at-rest positions;

said base segment being tapered from a maximum transverse thichness at said one end portion of said hollow spine to a minimum transverse thickness at an opposite end portion of said hollow spine to transmit force of said actuating means from said one end portion of said hollow spine to said opposite end portion of said hollow spine.

6. A ring binder comprising a one piece body including a stationary base segment and first and second leaf segments, said base segment including a pair of spaced apart longitudinal side members extending upwardly from opposite longitudinal ends of a base member of said base segment, a first longitudinally extending portion of reduced thickness being integrally hingedly connected between an upper longitudinal portion of one of said side members and an outer longitudinal portion of said first leaf segment, a second longitudinally extending portion of reduced thickness being integrally hingedly connected between an upper longitudinal portion of the other of said side members and an outer longitudinal portion of said second leaf segment, a third longitudinally extending portion of reduced thickness being integrally hingedly connected between an inner longitudinal portion of said first leaf segment and an inner longitudinal portion of said second leaf segment so that said base segment and said first and second leaf segments define a longitudinally hollow spine, said first and second leaf segments being vertically movable between a first at-rest position and a second at-rest position, said inner portions of said first and second leaf segments being closer to said base member in said first at-rest position than in said second at-rest position, said outer longitudinal portions of said first and second leaf segments when in said at-rest positions having a first transverse spacing therebetween substantially equal to a second transverse spacing between said upper longitudinal portions of said side members, said outer longitudinal portions of said first and second leaf segments when disposed in any other position between said at-rest positions having a third transverse spacing therebetween substantially equal to a fourth transverse spacing between said upper longitudinal portions of said side members, said base segment being at least partially elastic laterally to allow outward movement of said upper longitudinal portions of said side members from said second transverse spacing to said fourth transverse spacing, said third transverse spacing between said outer longitudinal portions of said first and second leaf segments being greater than said second transverse spacing between said upper longitudinal portions of said side members to effect a toggle-like joint limiting said first and second leaf segments to either one of first and second at-rest positions, each of said first and second segments having at least one ring half integrally formed therewith, said one ring half on said first leaf segment being corresondingly disposed in confronting relationship with said one ring half provided on said second leaf segment, said corresponding ring halves being movable between a contacting position when said first and second leaf segments are in said first at-rest position and a laterally spaced apart position when said first and second leaf segments are in said second at-rest position;

one end portion of said hollow spinebeing provided with actuating means having one edge portion integrally connected to one lateral end of reduced thickness of said first leaf segment and another edge portion of said actuating means being integrally connected to an adjacent associated lateral end of reduced thickness of said second leaf segment to move said first and second leaf segments between said first and second at-rest positions, said actuating means extending outwardly from said lateral ends of said first and second leaf segments to define a free end portion, said first and second leaf segments being disposed in said first at-rest position with said ring halves being in said contacting position when said actuating means end portion is moved upwardly toward an opposite end portion of said hollow spine, and said first and second leaf segments being disposed in said second at-rest position with said ring halves being in spaced apart position when said actuating means end portion is moved downwardly away from said opposite end portion of said hollow spine;

said first transverse spacing between said outer longitudinal portions of said first and second leaf segments is tapered from a maximum spacing at said one end portion of said hollow spine to a minimum spacing at said opposite end portion of said hollow spine to transmit force of said actuating means from said one end portion of said hollow spine to said opposite end portion of said hollow spine.

7. A ring binder as claimed in claim 6, wherein said first, second and third longitudinal extending portions of reduced thickness are each provided with at least one longitudinal slot therethrough in order to enhance ease by which said first and second leaf segments are movable between said first and second at-rest positions, said first and second leaf segments being provided with rib-like means for stiffening said first and second leaf segments, said rib-like means including rib-like members disposed longitudinally along undersurfaces of said first and second leaf segments for abutting against said base segment in said first at-rest position to limit extent to which said first and second leaf segments can be moved.

* * * * *